US005931752A

United States Patent [19]

Guenther et al.

[11] Patent Number: 5,931,752

[45] Date of Patent: Aug. 3, 1999

[54] INFLATABLE GAME BALL WITH LAID-IN CHANNEL OR LOGO

[75] Inventors: Douglas G. Guenther, Carol Stream; Bradley Lee Gaff, Naperville, both of Ill.

[73] Assignee: Wilson Sporting Goods Co., Chicago, Ill.

[21] Appl. No.: 09/007,348

[22] Filed: Jan. 15, 1998

[51] Int. Cl.[6] ..... A63B 41/00

[52] U.S. Cl. ..... 473/597; 473/604

[58] Field of Search ..... 473/596, 597, 473/598, 599, 600, 603, 604, 605, 606, 607, 608, 609, 610, 611

[56] References Cited

U.S. PATENT DOCUMENTS

| | | | |
|---|---|---|---|
| 1,240,866 | 9/1917 | Miller . | |
| 1,402,682 | 1/1922 | Takashima . | |
| 1,614,853 | 1/1927 | Schwartz . | |
| 2,061,604 | 11/1936 | Winterbauer . | |
| 2,494,796 | 1/1950 | Brown . | |
| 2,494,806 | 1/1950 | Gibson . | |
| 2,761,684 | 9/1956 | Crowley . | |
| 2,789,821 | 4/1957 | Crowley . | |
| 2,819,753 | 1/1958 | Nogue . | |
| 2,839,853 | 6/1958 | Giangreco | 40/327 |
| 2,896,949 | 7/1959 | Dunker . | |
| 3,119,618 | 1/1964 | Molitor . | |
| 3,219,347 | 11/1965 | Way . | |
| 3,256,019 | 6/1966 | Barton . | |
| 3,506,265 | 4/1970 | Yugi . | |
| 3,863,923 | 2/1975 | Anderson . | |
| 3,948,518 | 4/1976 | Tebbetts, Jr. | 473/605 |
| 4,093,219 | 6/1978 | Piraud . | |
| 4,187,134 | 2/1980 | Svub . | |
| 4,239,568 | 12/1980 | Takazawa . | |
| 4,333,648 | 6/1982 | Aoyama . | |
| 4,462,590 | 7/1984 | Mitchell . | |
| 4,660,831 | 4/1987 | Kralik . | |
| 5,040,795 | 8/1991 | Sonntag . | |
| 5,069,935 | 12/1991 | Walters . | |
| 5,310,178 | 5/1994 | Walker . | |
| 5,320,345 | 6/1994 | Lai . | |
| 5,413,331 | 5/1995 | Stillinger . | |
| 5,500,956 | 3/1996 | Schulkin . | |
| 5,542,662 | 8/1996 | Kouzai . | |
| 5,551,688 | 9/1996 | Miller . | |
| 5,636,835 | 6/1997 | Schindler . | |
| 5,669,838 | 9/1997 | Kennedy . | |
| 5,681,233 | 10/1997 | Guenther et al. | 473/605 |

FOREIGN PATENT DOCUMENTS

| | | |
|---|---|---|
| 1097165 | 6/1995 | France . |
| WO 96/35482 | 11/1996 | WIPO . |

*Primary Examiner*—Steven Wong
*Attorney, Agent, or Firm*—Tilton, Fallon, Lungmus & Chestnut

[57] ABSTRACT

A game ball comprises an inflatable carcass, panels of cover material secured to the carcass so that portions of the carcass are not covered with cover material, and pieces of material having good grippability which are secured to the portions of the carcass which are not covered by the cover material. The laid-in material can form channels or a logo on the ball.

5 Claims, 2 Drawing Sheets

INFLATABLE GAME BALL WITH LAID-IN CHANNEL OR LOGO

BACKGROUND

This invention relates to game balls, and, more particularly, to an inflatable game ball with laid-in channels and/or logo.

Game balls such as basketballs, soccer balls, and footballs conventionally include an inflatable bladder and a cover. The bladder may be reinforced with windings of nylon thread, polyester thread, etc. The cover is conventionally formed from panels of cover material, for example, leather, synthetic leather, or rubber. Adjacent panels are separated by rubber channels.

The portion of the ball excluding the cover is conventionally referred to as the carcass. Historically, basketballs have been made by first forming an inflatable rubber bladder, inflating the bladder, and molding the bladder under heat and pressure to vulcanize the rubber. After the bladder is removed from the mold, the bladder is wound with reinforcing thread which forms a layer of windings. The thread may be dipped in latex or adhesive. Pieces of rubber are then laid over the wound bladder, and the rubber-covered wound bladder is molded under heat and pressure to vulcanize or cure the pieces of rubber and to fuse the pieces of rubber to each other and to the layer of windings. The molded product is the carcass.

The surface of the carcass mold is provided with grooves which form upwardly extending projections on the surface of the carcass. The projections will form the seams or channels of the completed ball. Panels of cover material are laid into the areas of the carcass between the channels, and the covered carcass is placed in a mold having the shape of the completed ball to form the ball under heat and pressure.

In order to improve a player's ability to grip the ball and to reduce the shock of impact, the carcasses of some game balls have included cushion material, for example, sponge rubber. U.S. Pat. No. 5,636,835 describes a basketball in which the carcass includes an inflatable bladder, a layer of windings over the bladder, a layer of sponge rubber, and strips of seam material. The completed carcass is illustrated in FIG. 5 of the patent, and the carcass is molded so that a raised central portion 22 is formed on each strip of seam material. After the carcass is formed, cover panels are attached to the carcass between the raised portions 22 of the seam material.

U.S. Pat. No. 5,681,233 describes another basketball which includes a layer of sponge rubber. However, panels of sponge rubber are spaced-apart in the areas of the channels, and rubber channel strips are positioned in the gaps and are secured directly to the wound bladder. The carcass includes the wound bladder, the layer of sponge rubber, and the strips of channel material. The carcass is molded under heat and pressure. After the carcass is formed, panels of cover material are laid over the sponge rubber.

A major problem with prior art inflatable game balls is that the channels which separate the cover panels are part of the molded carcass. The material of the channels has relatively poor grippability and a relatively low coefficient of friction compared to the material of the cover panels. The channels are relatively slippery and limit the grip and feel of the ball.

Another problem with inflatable game balls is caused when a logo such as a brand name, trademark, design, or other indicia is applied to the cover. Many logos are applied with a decal which includes a layer of ink on a release liner. The decal is pressed onto the cover of the ball and heat may be applied. When the release liner is peeled away, the ink remains on the cover. However, the ink is usually more slippery than the cover and interferes with grip and feel.

SUMMARY OF THE INVENTION

In accordance with the invention, the carcass is molded without the channels. Instead, strips of channel material are layed on the carcass after the carcass is molded. The channels can be laid on either before or after applying the cover panels. Since the channel strips are applied separately, the material of the channels is independent from the material of the carcass. This allows greater flexibility in the choice of material for the channels. The performance of the channels can thereby be matched to the performance of the cover material, thus enhancing the grip and feel of the ball.

Logos can also be formed by laying in pieces of material after the carcass is formed. For example, the cover can be provided with an opening in the shape of the logo. A separate piece of material in the shape of the logo is laid into the opening in the cover. The logo material has a color which contrasts with the color of the cover to make the logo more visible. The material of the logo can be selected to match the performance of the cover material to enhance grip and feel.

DESCRIPTION OF THE DRAWING

The invention will be explained in conjunction with an illustrative embodiment shown in the accompanying drawings, in which.

DESCRIPTION OF SPECIFIC EMBODIMENT

The invention will be explained with reference to a basketball 10 illustrated in FIG. 1. It will be understood, however, that the invention can be used with other inflatable game balls. The basketball 10 includes an inflatable bladder 11 (FIG. 3), a plurality of cover panels 12, and rubber channels 13 which separate adjacent cover panels.

The bladder 11 may be manufactured in the conventional manner from conventional bladder materials. The bladder is preferably formed primarily of rubber. In the preferred embodiment the bladder was made from 80% butyl rubber and 20% natural rubber.

Figure 2:
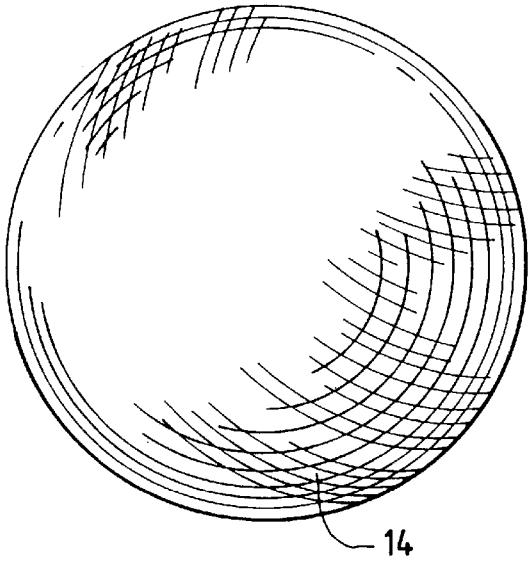
FIG. 2 illustrates the bladder.
Figure 3:
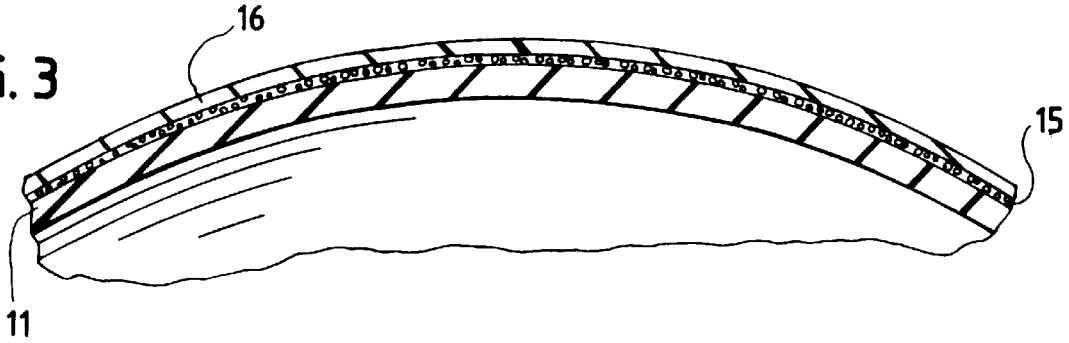
FIG. 3 is a fragmentary sectional view of the wound bladder with a layer of rubber.

The bladder is inflated and placed in a vulcanizing or curing mold where the bladder is cured at 160° C. After curing, the inflated bladder is wound with reinforcing thread 14 (FIG. 2) which forms a layer of windings 15 (FIG. 3). In the preferred embodiment the layer of windings was formed from 2100 meters of 210 denier Nylon 66 thread. The thread is preferably coated with latex or adhesive.

Flat sheets or panels of rubber 16 are laid over the wound bladder. The rubber panels can be natural and/or butyl rubber or can be sponge rubber as described in U.S. Pat. No. 5,681,233. The rubber completely covers the wound bladder.

Figure 4:
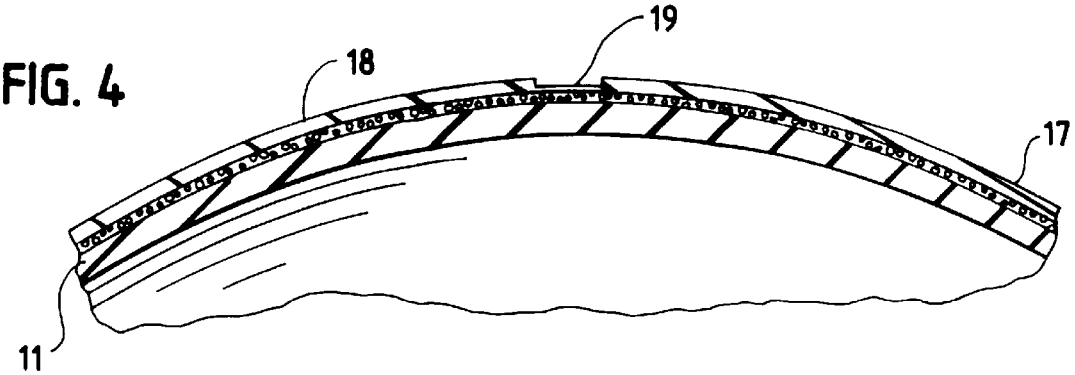
FIG. 4 is a fragmentary sectional view of the carcass as would be seen along the line 4—4 of FIG. 1.

The inflated rubber-covered bladder is then placed in a spherical carcass mold where it is heat molded at about 160° C. to form the carcass 17 (FIG. 4). During the molding process, the rubber panels fuse to each other and to the windings 14 and form an integral outer rubber layer 18 on the carcass.

The inside surface of the carcass mold includes inwardly extending projections which form inwardly extending grooves 19 in the outer rubber layer 18. The grooves are formed in the areas which will form the channels 13 on the completed ball.

Figure 5:
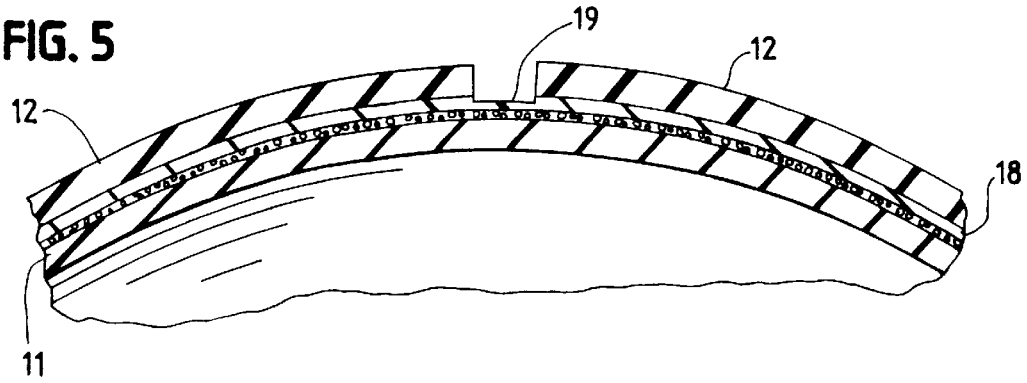
FIG. 5 is a sectional view of the carcass similar to FIG. 4 showing panels of cover material applied to the carcass.

After the carcass is removed from the carcass mold, panels of cover material 12 are laid over the carcass between the grooves 19 as shown in FIG. 5. Each cover panel has the shape of one of the areas of the carcass which is bounded by the grooves 19. Adjacent cover panels 12 are separated over the channel areas 19 of the carcass as shown in FIG. 5.

The cover panels may be any conventional cover material for example, leather, synthetic leather, rubber, etc. The outer surface of each cover panel can have the traditional pebbled texture. Each cover panel advantageously includes a fabric backing which may be coated with adhesive before being applied to the carcass. The carcass may also be coated with adhesive.

Figure 6:
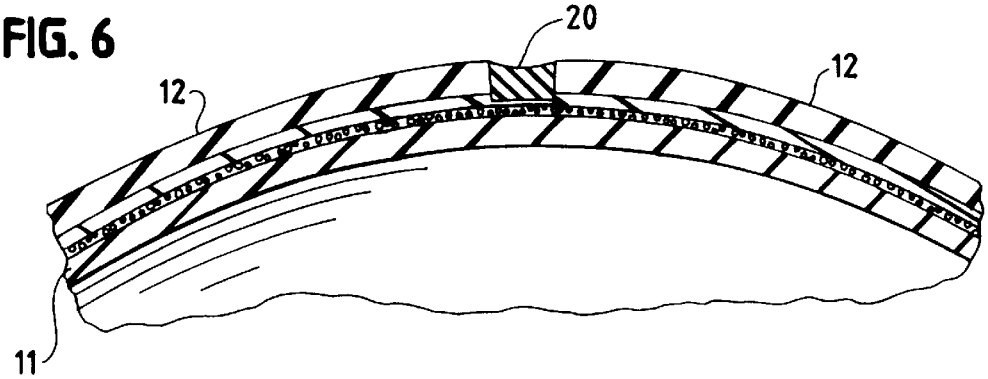
FIG. 6 is a sectional view similar to FIG. 5 showing strips of channel material laid into the channel areas of the ball.

Referring to FIG. 6, strips 20 of channel material are laid in the gaps between adjacent cover panels and into the grooves 19. The material of the channel strips 20 has good grippability and a relatively high coefficient of friction. The channel material is advantageously selected to match the grip and feel of the cover panels so that the channels do not provide slippery areas on the surface of the ball. The color of the channel material preferably contrasts with the color of the cover to provide visible evidence of the channels. For example, the channels are conventionally black.

In one specific embodiment the material of the channels was urethane-coated microfiber having a thickness of about 1½ mm. The material is available from Teijin, Ltd. of Izumo, Japan. The bottom surface of the material is advantageously coated with adhesive to adhere the material to the carcass until the final molding step which is described below.

Alternatively, the strips 20 of channel material can be laid into the grooves 19 of the carcass before the cover panels are applied. The cover panels are then applied to the carcass between the channels.

The ball is completed by placing the inflated carcass with the cover panels and channel strips into a spherical mold which has the shape of the final ball. The ball is heat molded at about 40° C. to bond the cover panels and the channels to the carcass and to each other. The final molding step can provide desired shape to the outer surfaces of the channels. In the particular embodiment illustrated, each channel has a concave outer surface which extends between the edges of adjacent cover panels.

Laid-in material can also be used to form a logo on the ball. As used herein, the term logo is meant to include a brand name, trademark, design, or other indicia on the outside surface of the ball which provides a recognizable image distinct from the cover.

Figure 1:
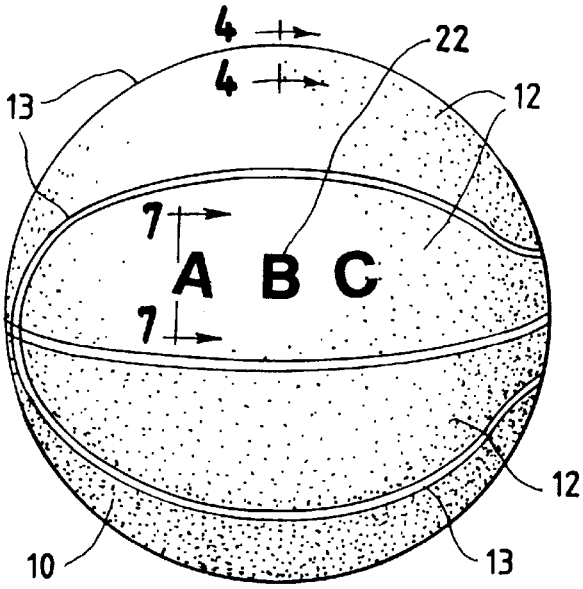
FIG. 1 illustrates a basketball formed in accordance with the invention.

Referring to FIG. 1, the ball 10 includes a logo 22. The logo is formed by cutouts or openings 23 in one or more of the cover panels 12 (see also FIG. 7). The openings form the outlines or contours of the elements of the logo.

Figure 7:
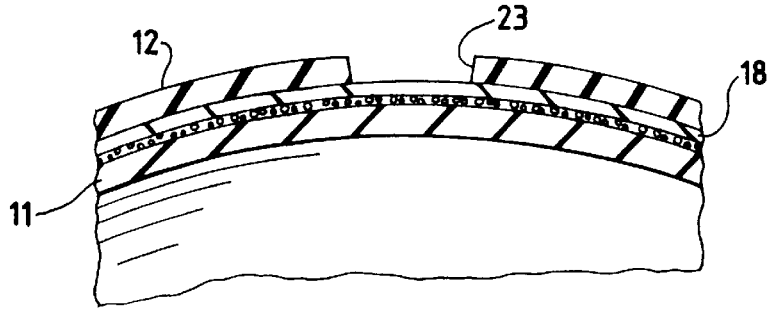
FIG. 7 is a fragmentary sectional view as would be seen along the line 7—7 of FIG. 1 showing an opening in the cover for forming a logo.

FIG. 7 illustrates a cover panel 12 applied to the carcass 17. The openings 23 expose the outer rubber layer 18 of the carcass.

Figure 8:
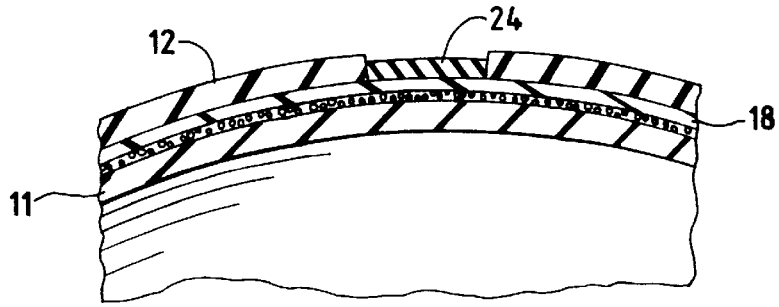
FIG. 8 is a sectional view similar to FIG. 7 showing logo material laid into the openings in the cover.

Referring to FIG. 8, a piece of logo material 24 is laid into each of the openings 23. Each piece of logo material has a shape corresponding to one of the openings.

The logo material has a cover or appearance which contrasts with the color or appearance of the cover so that the logo is readily visible. For example, the logo material can be black.

The logo material is also selected to match the performance, grip, and feel of the cover material. In the preferred embodiment, the logo material is the same as the channel material.

The logo material is laid in before the final molding operation so that the logo material is bonded to the carcass and to the cover at the same time as the channel material. The logo material can be coated with adhesive to adhere the material to the carcass until the final molding step.

Because the logo material is separate from the cover panels, the logo can be raised or lowered relative to the surface of the cover panels to provide an attractive offset appearance and tactile evidence of the logo. In the embodiment illustrated, the outer surface of the logo is slightly depressed relative to the surface of the cover.

While in the foregoing specification a detailed description of a specific embodiment of the invention was set forth for the purpose of illustration, it will be understood that many of the details herein given may be varied considerably by those skilled in the art without departing from the spirit and scope of the invention.

We claim:

1. A game ball comprising:

a carcass which includes an inflatable bladder;

a plurality of panels of cover material secured to the carcass, portions of the carcass not being covered by the cover material, and pieces of laid-in material having good grippability which are formed separately from the carcass and which are secured to the portions of the carcass which are not covered by the cover material, the cover material not extending over any portion of the laid-in material.

2. The game ball of claim 1 in which said pieces of laid-in material form a logo.

3. The game ball of claim 1 in which said carcass is provided with an inwardly extending groove below each of said pieces of laid-in material.

4. A method of making a game ball comprising the steps of:

forming a carcass which includes an inflatable bladder, securing a plurality of panels of cover material to the carcass so that adjacent panels of cover material are separated by gaps and portions of the carcass are not covered by the cover material, inserting pieces of laid-in material having good grippability into the gaps, and securing the laid-in material to the portions of the carcass which are not covered by the cover material so that the cover material does not extend over any portion of the laid-in material.

5. The method of claim 4 in which said step of forming a carcass includes forming inwardly extending grooves in the carcass where said pieces of laid-in material will be secured.

* * * * *